United States Patent [19]

Dubak et al.

[11] Patent Number: 4,757,430

[45] Date of Patent: Jul. 12, 1988

[54] ENTRANCE DOOR NIGHT LIGHT

[76] Inventors: Glenda A. Dubak; Peter D. Capizzo, both of 76376 Romeo Plank Rd., Romeo, Mich. 48065

[21] Appl. No.: 867,206

[22] Filed: May 27, 1986

[51] Int. Cl.[4] ..... E05B 17/10

[52] U.S. Cl. ..... 362/100; 362/190; 362/276; 361/175

[58] Field of Search ..... 362/100, 116, 253, 190, 362/191, 155, 154, 802, 276, 157; 315/155, 149; 361/175; 250/200, 215, 211 R; 340/600

[56] References Cited

U.S. PATENT DOCUMENTS 2,043,671 6/1936 McMaster et al. ..... 361/175

2,813,195 11/1957 Willey et al. ..... 362/100

*Primary Examiner*—Ira S. Lazarus

*Assistant Examiner*—D. M. Cox

[57] ABSTRACT

An entrance door night-light contained within an enclosure that is mounted to the head of an entrance doorway between the storm door and the entrance door. The enclosure is positioned to project light onto the door-handle and lockset area. The enclosure contains a lamp, powered by a DC voltage source, a momentary switch that makes contact with the storm door and is used to switch the lamp on when the storm door is opened, and a photocell used to keep the lamp off during daylight, even when the storm door is open.

5 Claims, 2 Drawing Sheets

ENTRANCE DOOR NIGHT LIGHT

BACKGROUND

This invention relates to a battery operated entrance door night-light. It is an object of this invention to provide lighting while entering or leaving and, more particularly, locking or unlocking an entrance doorway, by utilizing the storm door and a photocell to turn the light on and off.

Presently, there are a few alternative methods of lighting entranceways. One is using the building or premise lighting (ie. porchlights). The disadvantage of this is that the light must be turned on when leaving the premises, and must remain on until a person returns and turns the light off. In this case, energy is wasted. Also, departure often occurs during daylight, and the light is not turned on, but arrival is at night when the light is needed.

Another method of lighting is to use a portable penlight. The disadvantage of a penlight is that it is cumbersome to work both the light and the key at the same time. Also, the penlight is bulky and uncomfortable to carry.

SUMMARY OF INVENTION

What the present invention provides is an inexpensive, energy efficient, long life, carefree lighting while using an entrance doorway.

The present invention consists of a small enclosure which contains: a DC voltage source for circuit control, a DC voltage source for lamp power, an incandescent lamp for lighting, a normally closed momentary switch operated by the storm door, and a photocell and circuitry for nighttime operation.

The enclosure is small enough to be mounted between the storm door and the entrance door, onto the head of the door frame, by means of mounting devices such as screws. The enclosure is positioned to hang over the door handle and lockset so that the momentary switch is facing the storm door and will make contact with the storm door when it is closed.

Functionally, the present invention operates as follows: during darkness when the storm door is opened, the switch closes causing the light to go on and stay on until the storm door is closed, making contact with the switch again, causing the switch to open and consequently turning the light off. The photocell is used to keep the light from going on during daylight even when the storm door is open.

From the above scenario, it is seen that the light therefore will be on only for the few seconds it takes to enter a doorway, therefore saving energy and prolonging the life of the batteries.

The present invention is convenient and carefree. It is mounted high and out of the way and operates by the simple action of entering or leaving a doorway.

Also, the present invention is a self-contained unit that requires no wiring changes or devices added to existing lighting systems, therefore making it inexpensive and easy to install.

DESCRIPTION OF THE PREFERRED EMBODIMENT

Figure 1:
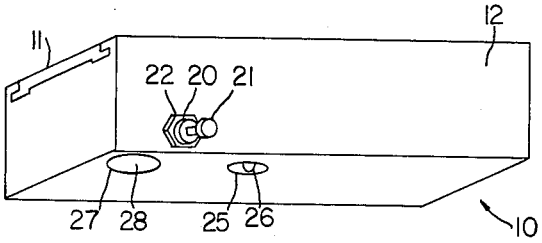
FIG. 1 is a perspective view of the housing of the invention looking at the bottom, left and front sides.

Referring to FIGS. 1–5, there is shown the device 10 comprising of a top cover 11 and a rectangular housing 12 with slots 13 used to slide housing 12 horizontally onto the top cover 11. The slots 13 are opened at both ends of the housing 12 so that the housing 12 can be slid on and off the top cover 11 at either end. This feature of the invention is useful for the installation of the device which is explained as follows: the top cover 11 is first secured to the head of the door frame (on the side over the doorhandle and locks set) with mounting screws 14 through mounting holes 15. The housing 12 is then slid onto the top cover 11 which holds the housing 12 in place.

The housing 12 contains three openings: the switch opening 20 for the momentary switch 21 secured in place by the retaining nut 22, the light opening 25 for the light bulb 26, and the photocell opening 27 for the photocell 28.

Figure 2:
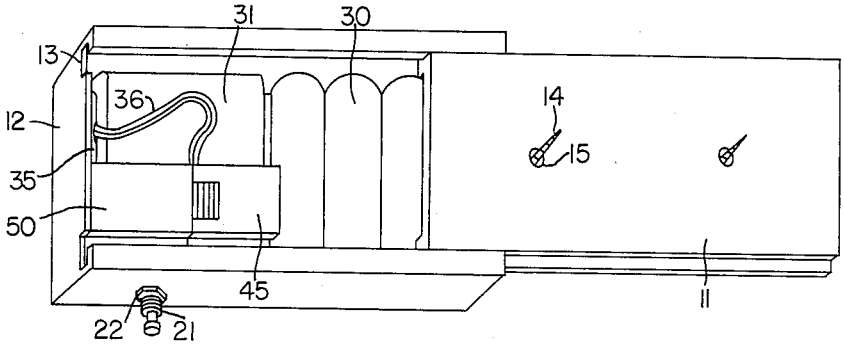
FIG. 2 is a perspective view of the housing of the invention looking at the top with the top cover partially removed.
Figure 3:
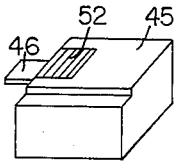
FIG. 3 is a perspective view of the light bulb cover of the device.
Figure 4:
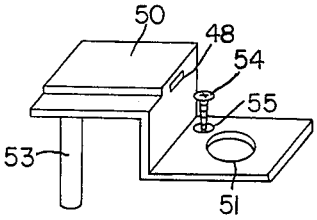
FIG. 4 is a perspective view of the circuit cover of the device.
Figure 5:
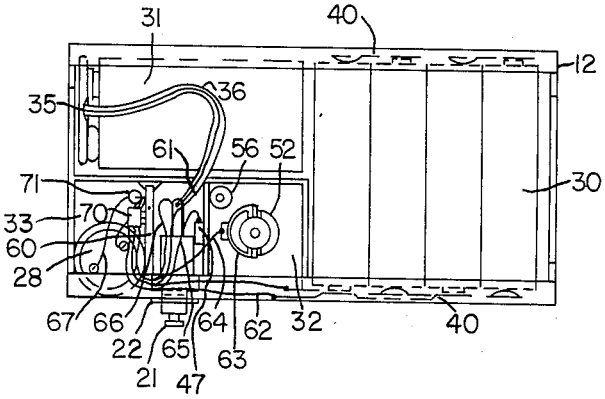
FIG. 5 is a plan view of the invention with all three covers removed to reveal the inner parts of the device.

Turning now to FIG. 2, the interior of the housing 12, there is space for four 1.5 volt AA cell batteries 30 aligned side by side (interconnected for a 3 volt source), a 9 volt battery 31, a light bulb compartment 32, and a circuit compartment 33 (shown with all covers removed in FIG. 5). FIG. 2 shows the preferred arrangement of the batteries 30 and 31, and compartments 32 and 33 within the housing 12. The 9 volt battery 31 is connected to the circuit by a common 9 volt terminal strap 35 with several inches of lead wires 36 which allow the 9 volt battery 31 to be removed without disconnecting it. With the 9 volt battery 31 removed it is then easy to remove the AA cell batteries 30 by inserting a finger where the 9 volt battery 31 was and prying the AA cells 30 loose from their terminal clips 40.

Covering the light bulb compartment 32 is a light cover 45 with a positive terminal post 46 attached to the upper underside of the cover 45. The terminal post 46 makes contact with the light bulb cathode tip and plugs into the positive light bulb socket 47 through an opening 48 in the circuit cover 50 when the light cover 45 is in place. Molded into the top of the light cover 45 is a set of friction grooves 52 used when sliding the light cover 45 on and off the light bulb compartment 32.

Covering the circuit compartment 33 is a circuit cover 50. The circuit cover 50 has an opening 51 for the light bulb 26 which is placed by inserting it through the opening 51 and into the lightbulb retainer 52 which is in the circuit compartment 33. Also, as previously mentioned, there is an opening 48 for the positive terminal post 46 attached to the light bulb cover 45. Attached to the underside of the circuit cover 50 is the photocell retaining post 53 used to keep the photocell 28 in the photocell opening 27. The circuit cover 50 is secured by placing the circuit cover retaining screw 54 through the screw opening 55 into a screw retaining post 56.

Turning now to FIG. 5, the placement and interconnection of the different components of the circuit are shown. As previously mentioned, the 9 volt battery 31 lays loosely in the housing 12 and is connected with a terminal strap 35 to the circuit board 60 and the momentary switch 21 by lead wires 36 which run through an opening 61 in the side of the circuit compartment 33. Four terminal clips connect the AA cell batteries 40 to the circuit board 60 by lead wires 62. The light bulb 26 is held in place by the light bulb retainer 52 which also holds the light bulb negative terminal clip 63 which is connected to the circuit board 60 by lead wire 64. As previously mentioned, the light bulb positive terminal post 46 plugs into the light bulb socket 47 which is connected to the circuit board 60 by lead wire 65. The momentary switch 21 is connected to the 9 volt battery 31 by lead wire 36 and to the circuit board by lead wire 66. The photocell 28 is connected to the circuit board by leads 67. On the circuit board 60 is attached a transistor 70 and a resistor 71.

Figure 6:
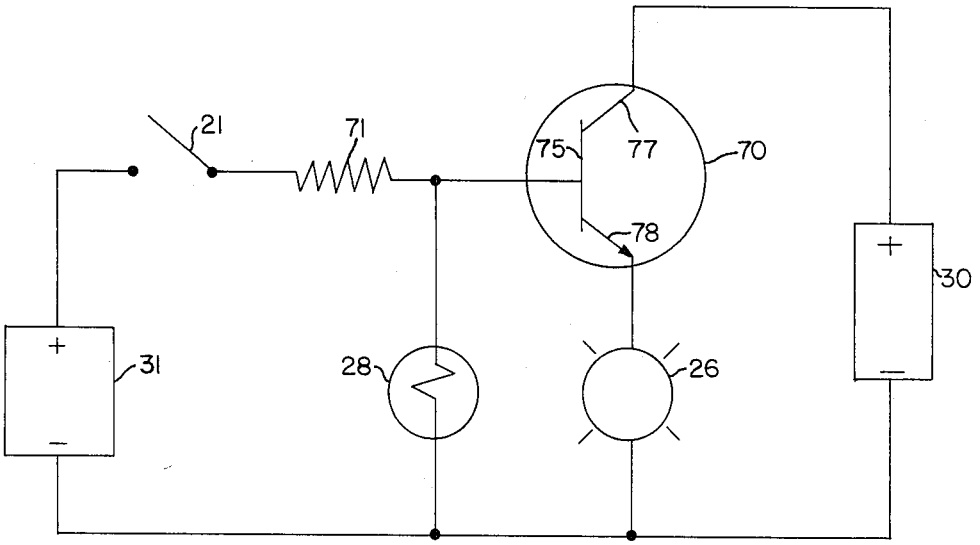
FIG. 6 is a schematic diagram of the circuit of the invention.

Finally, in FIG. 6 the operation of the circuit is shown. The 9 volt DC voltage source 31 is utilized to forward bias the transistor 70 into the on or conducting state. The resistor 71 is connected in series with the voltage source 31 and reduces the voltage to an optimal level at the transistor base 75 for forward biasing. The photocell 28 is connected between the base 75 and the source return 76 (referred to as ground). The resistance of the photocell is controlled by the level of ambient light intensity. The higher the ambient light intensity the lower the resistance. During daylight, the photocell 28 acts effectively as a short between the base 75 and ground 76. Therefore, the transistor 70 cannot be forward biased to an on state during daylight or when there is sufficient level of ambient light ie. that produced by a porchlight). But during periods of darkness, the resistance of the photocell 28 is increased so that it will effectively act as an open circuit between the base 75 and ground 76. Then the voltage level at the base 75 will be determined by resistor 71 value and the equivalent impedance of the transistor and light bulb acting as a voltage divider. The value of the resistor is selected to bias the transistor on when the photocell 28 is in an open circuit state. When the photocell 28 is in a short circuit state, the resistor 71 will act as a leakage current limiter. Leakage current from the 9 volt source 31 will occur only during periods of both daylight and door open (switch 21 closed) conditions, and will be small enough not to effect the overall life of the source 31. This arrangement is preferred so that the light bulb 26 will not come on, draining the 3 volt source 30, at unnecessary times, greatly reducing the life of the 3 volt source.

When the transistor 70 is biased on, the 3 volt source 30 (preferably consisting of 4 AA cell batteries arranged in two sets of two in series for long life of the device), connected to the transistor collector 77, will drive a current, sufficient to power on the light bulb 26. The light bulb 26 is connected between the transistor emitter 78 and ground 76.

In series with the 9 volt source 31 is a normally closed momentary switch 21 connected between the source 31 and the resistor 71. The switch is used to turn the biasing current on and off. when the storm door is opened or closed respectively.

In summary, the light will come on only when the door is opened during darkness. During daylight, the photocell will short the biasing current to keep the light off, even if the door is open. This arrangemnt insures a long life of the batteries and reduces the inconvenience and expense of replacing the batteries.

Typical component values are as follows:

| | |
|---|---|
| Resistor | Kilohms 2.0 |
| Transistor | NPN 2N4401 |
| Photocell | Maximum Resistance 100 Kilohms<br>Minimum Resistance 250 Ohms. |

The present invention is well adapted to carry out the object and attain the ends and advantages mentioned, as well as other inherent therein. While presently preferred embodiment is given for the purpose of disclosure, numerous changes in the details of construction and arrangement of parts can be made, which will readily suggest themselves to those skilled in the art, and which are encompassed within the spirit of the invention and the scope of the appended claims.

I claim:

1. A night light for attachment between an entrance door having a lock set and an adjacent screen door, said night light comprising:

an enclosure for mounting between the entrance door and the adjacent screen door, said enclosure having a plurality of openings formed therein;

a DC voltage source mounted within said enclosure;

a first switch affixed to said enclosure adjacent one of said openings for sensing the proximity of the screen door;

a light source affixed to said enclosure adjacent one of said openings for directing light upon the lock set;

a light sensor for detecting ambient light level, said light sensor affixed to said enclosure adjacent one of the openings formed therein; and a second switch which cooperates with the light sensor, said second switch being closed at low ambient light levels, and open at high ambient light levels;

whereby said DC voltage source, light source, first switch, second switch and light sensor are electrically connected so that when the screen door is open, thereby closing the first switch, and the ambient light level is low enough to thereby cause the second switch to close, the electrical circuit will be completed causing the light source to illuminate the lock set, and when the ambient light level is high enough to cause the second switch to open, the electrical circuit will be broken, thereby preventing the light source from illuminating the lock set.

2. An entrance door night light comprising:

an enclosure having a plurality of openings formed therein:

a first and second DC voltage source each having a positive and negative terminal, said negative terminals connected together at a common ground point;

a transistor having a base, a collector and an emitter with the collector connected to the first voltage source positive terminal;

a light source connected between the transistor emitter and the ground point, said light source mounted adjacent an opening in the enclosure allowing the light source to project light out;

a resistor having a first and second lead, with the first lead connected to the transistor base;

a normally closed momentary switch connected between the second lead of the resistor and the positive terminal of the second DC source, said momentary switch mounted adjacent an opening in the enclosure allowing the momentary switch to extend out of the enclosure; and a photocell connected between the transistor base and the ground point, mounted adjacent an opening in the enclosure allowing light to enter and activate the photocell.

3. An entrance door night-light of claim 1 wherein the enclosure also contains a second DC voltage source used to activate the second switching device.

4. An entrance door night light of claim 2 wherein a housing consists of a rectangular enclosure with a compartment for the first DC source, a compartment for the second DC source, a compartment for the light source, a compartment for the transistor, resistor, photocell and momentary switch, a cover for the light source compartment, a cover for the electronic compartment, and a housing cover that is attachable above the entrance door so that the housing will be in a position to project light onto the lock set area and will be removable for servicing.

5. An entrance door night-light of claim 4 wherein the housing, compartments, and covers are made of plastic.

* * * * *